United States Patent [19]

Oya

[11] Patent Number: 4,638,136

[45] Date of Patent: Jan. 20, 1987

[54] MICROWAVE OVEN WITH DOOR LATCHING ASSEMBLY

[75] Inventor: Yuichiro Oya, Sakai, Japan

[73] Assignee: Sharp Kabushiki Kaisha, Osaka, Japan

[21] Appl. No.: 707,204

[22] Filed: Mar. 1, 1985

[30] Foreign Application Priority Data

Mar. 1, 1984 [JP] Japan ..... 59-30298[U]

[51] Int. Cl.[4] ..... H05B 6/76

[52] U.S. Cl. ..... 219/10.55 C; 200/50 A; 126/197

[58] Field of Search ..... 219/10.55 C, 10.55 D, 219/10.55 B; 200/50 A, 50 R; 126/197

[56] References Cited

U.S. PATENT DOCUMENTS

| | | | |
|---|---|---|---|
| 3,639,717 | 2/1972 | Mochizuki | 219/10.55 C X |
| 4,006,121 | 2/1977 | Isono | 219/10.55 C X |
| 4,321,445 | 3/1982 | Kristof et al. | 219/10.55 C |
| 4,341,409 | 7/1982 | Sakoda | 219/10.55 C X |
| 4,450,335 | 5/1984 | Shimizu et al. | 219/10.55 C |
| 4,497,993 | 2/1985 | Aoyama | 219/10.55 C |
| 4,504,719 | 3/1985 | Taylor, Jr. et al. | 219/10.55 C |
| 4,516,007 | 5/1985 | Ringdahl et al. | 219/10.55 C |

FOREIGN PATENT DOCUMENTS

| | | | |
|---|---|---|---|
| 52-14947 | 2/1977 | Japan | 219/10.55 C |
| 54-34150 | 3/1979 | Japan | 219/10.55 C |

*Primary Examiner*—Philip H. Leung

*Attorney, Agent, or Firm*—Birch, Stewart, Kolasch & Birch

[57] ABSTRACT

The preferred embodiment provides an improved microwave oven structure, more particularly, a mechanism related to the installation of the latch-hook engaging the latch-head of the door set to the front entrance of the oven. The improved mechanism is established by setting the oven unit inside the housing, installing the door at the front entrance, installing the door opening/-closing mechanical unit to the floor behind the front panel aligned with the door, installing the latch-hook engaging the latch-head of the door behind the peripheral edge of the door opening/closing mechanical unit of the front entrance, and installing the vertical baseplate to be integrally set to the front entrance part of the door opening/closing mechanical unit. The improved mechanism is completed by securing the latch-hook to the vertical baseplate.

4 Claims, 4 Drawing Figures

MICROWAVE OVEN WITH DOOR LATCHING ASSEMBLY

BACKGROUND OF THE INVENTION

The present invention relates to a microwave oven, more particularly, to the improved mechanical structure of the latch-hook that securely holds the latch-head of the door of the microwave oven.

Conventionally, the front door of the microwave oven is closed by a latching mechanism. The latch-head projecting from the door is secured to the latch-hook provided inside the peripheral edge of the front entrance of the microwave oven. The conventional microwave oven is provided with the latch-hook (a) shown in the sectional view of FIG. 1 and in the exploded view of FIG. 2. The latch-hook (a) is set to the internal surface of the bent part (c) of the front panel that makes up part of the microwave oven unit (b). Reference code (d) indicates the door, (e) the front panel, and (f) the latch-head. The latch-head is installed manually by inserting the hand into the housing from the rear. However, since the installation work is done at a position remote from the external surface, manual assembly is always rather difficult. In addition, since the bent panel (c) that houses the latch mechanism is not thick enough to withstand external force, it may be accidentally deformed while manually assembling the latch mechanical unit. A latching mechanism for the door of a microwave oven was disclosed in detail in U.S. Pat. No. 4,341,409 "DOOR LATCHING ASSEMBLY" (Inventor: SAKODA YASUHIRO) owned by the assignee of the present application.

OBJECT AND SUMMARY OF THE INVENTION

In the light of the disadvantage thus described, the present invention aims at providing a microwave oven featuring a new mechanism that allows the latch-hook to be assembled very easily. The preferred embodiment makes it possible to easily install the latch-hook by effectively using the door opening/closing mechanical unit set within the peripheral edge of the front entrance. Details of this configuration are described below. A microwave oven incorporating the preferred embodiment of the present invention is assembled by first inserting an oven unit into the housing, then installing the front door, installing the door opening/closing mechanical unit to the floor behind the front panel which is aligned with the door, and installing the latch-hook which-engages the latch-head connected to the door behind the peripheral edge of the door opening/closing mechanical unit of the front entrance of the microwave oven unit. The latch-hook is secured to the vertical base plate which is integrally set to the front entrance of the door opening/closing mechanical unit.

Compared to conventional assembly mechanisms, the preferred embodiment provides an extremely useful mechanism that allows easy assembly of the latch-hook into the latch mechanical unit by first securing the latch-hook onto the door opening/closing mechanical unit. This enables the assembler to securely install the latch-hook at the same time the door opening/closing mechanical unit is assembled. In addition, the mechanical structure is more durable providing a longer service life. In contrast, the conventional mechanical structure causes a gap to develop between the front panel (e) and the bent piece (c) set for securing the latch-hook (a) onto the panel that makes up part of the oven unit (b) shown in FIG. 1. This eventually allows microwaves to leak from the gap. To prevent this, the conventional structure uses an aluminum plate (g) to shield the gap. Since the preferred embodiment dispenses with the bent piece (c), this piece can be bent in the opposite direction to eliminate the gap. As a result, the structure embodied by the present invention provides substantial advantages over the conventional assembly process, including a reduction in production cost.

DETAILED DESCRIPTION OF THE INVENTION

Referring now to the attached drawings, the preferred embodiment of the present invention is described below. It should be understood, however, that the scope of the present invention is not limited by the preferred embodiment described below.

Figure 1:
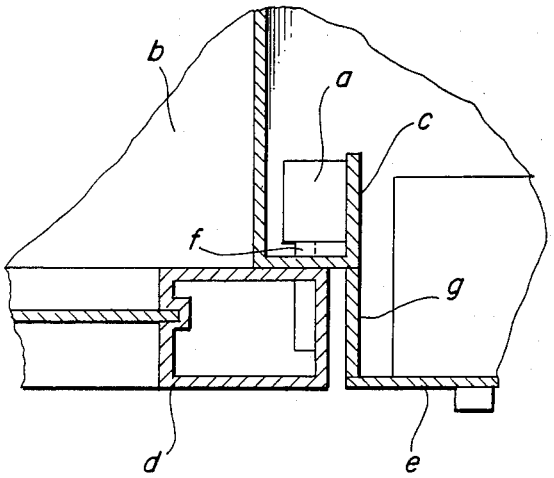
Fig. 1 PRIOR ART
FIGS. 1 and 2 respectively show a sectional view of the latch-hook mounted structure of a conventional microwave oven unit and an exploded view of the latch mechanism.
Figure 2:
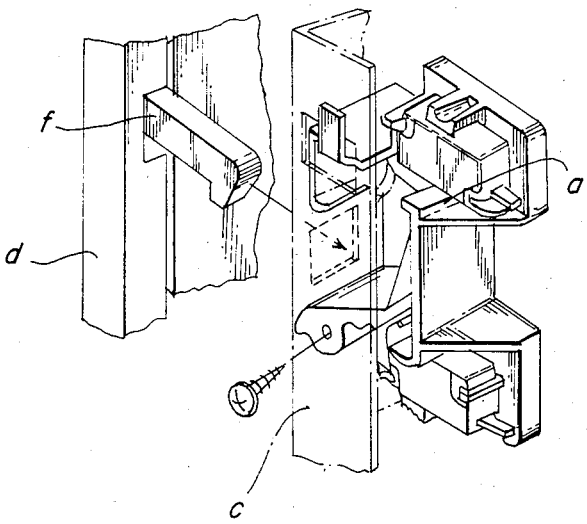
Fig. 2 PRIOR ART
Figure 3:
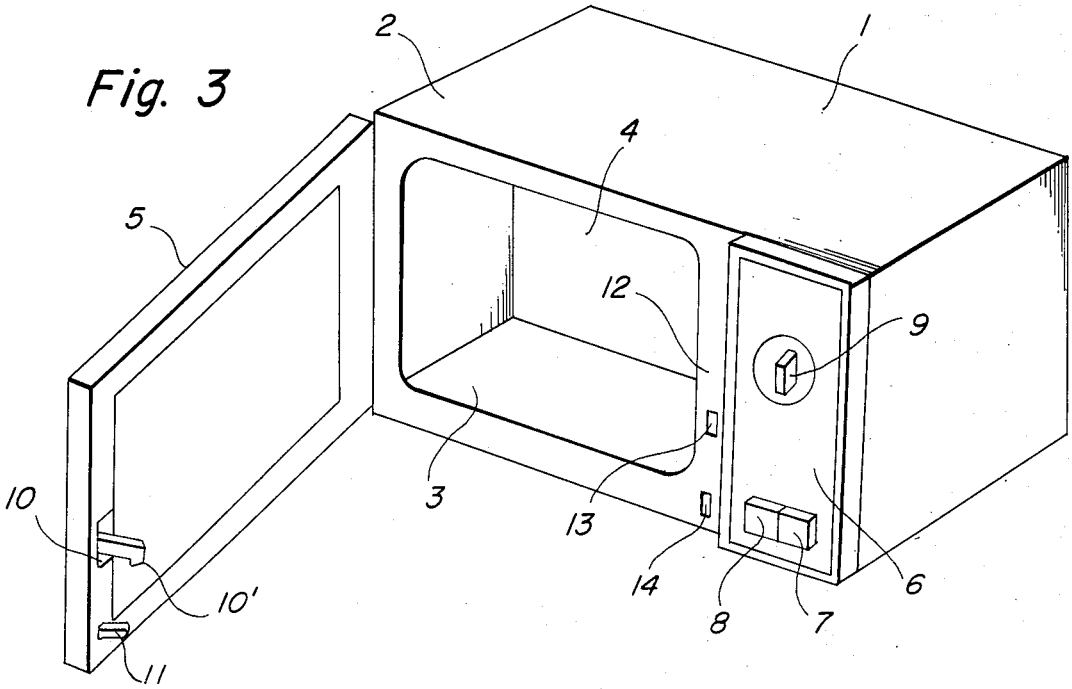
FIG. 3 is a perspective view of the microwave oven incorporating the preferred embodiment of the present invention.

FIG. 3 is the external configuration of the microwave oven incorporating the preferred embodiment of the present invention, showing no difference from conventional microwave ovens. An oven unit is provided inside the housing (2). The door (5) is secured to the front entrance (4) of the oven unit (3). The front panel (6) is aligned with the door (5) installed on the front surface of the microwave oven unit (1). The front panel (6) is provided with a door opening/closing button (7), a cooking button (8), and a timer (9). The latch-head (10) and the head-lever (11) both project from the rear surface of the door (5). Holes (13) and (14) are provided to receive the latch-head (10) and the head-lever (11) respectively when the door (5) is closed. The closed door contacts the peripheral edge (12) of the front entrance (4).

Figure 4:
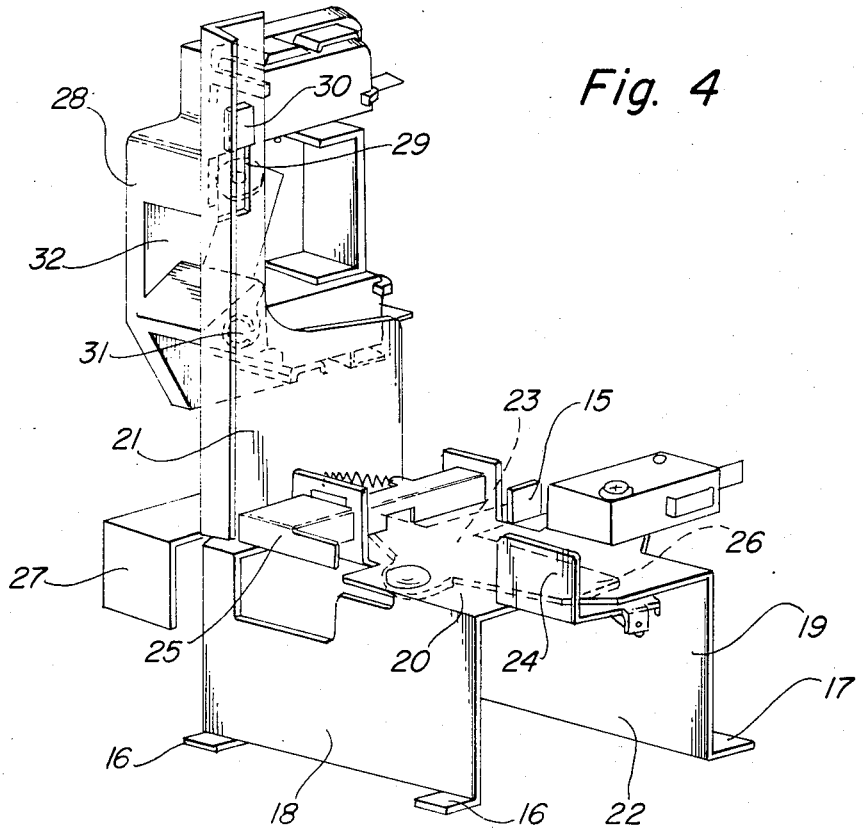
FIG. 4 is a schematic diagram showing the latch mechanism embodied in the present invention.

The door opening/closing mechanical unit (15) shown in FIG. 4 is secured to the bottom plate (not shown) of the housing (2) behind the front panel (6). The door opening/closing mechanical unit (15) is installed in such a manner that its rear feet (17) are secured to the bottom plate with screws (not shown), whereas the front feet (16) are secured to the positioning holes provided for the bottom plate. The door opening/closing mechanical unit (15) is comprised of a door-release lever (23), a door-release lever control unit (24), and a cooking control unit (25). The door opening/closing mechanical unit (15) is secured to a metal base (22) and is comprised of front and rear vertical plates (18) and (19), a horizontal plate (20) provided between the vertical plates (18) and (19), and the vertically set base plate (21) bent from the side-edge of the horizontal plate (20). The door-release lever control unit (24) and the cooking control unit (25) are positioned in such a manner that they can be depressed by the door-releasing button (7) and the cooking button (8), respectively. The extreme-end plate (27) opposite the edge (26) facing the door-release lever control unit (24) is provided inside the head-lever receiving hole (14). The vertical base plate (21) is positioned to face the front entrance (4) of the oven unit (3), whereas the latch-hook (28) is secured to the external surface of the vertical base plate (21) with screws (31) with the upper stopper (30) coupled to the stopper hole (29) located on the upper portion of the vertical base plate (21). The latch-hook (28) is set so that the hook unit (32) can be positioned inside the hook-receiving hole (13). The latch-hook (28) is first secured to the door opening/-closing unit (15) before being set in position simultaneously with installation of the door opening/closing unit (15) inside the housing (2). The opening/closing operation based on the mechanism of the preferred embodiments is described below.

When the door-release button (7) is pressed while the door is closed, the edge (26) of the door-releasing lever (23) is pressed by the door-release lever control unit (24), thus causing the other edge (27) to move forward. The edge (27) then presses the head-lever (11). As a result, the head lever (11) activates the latch-head (10) so that the claw (10′) rises. This causes the claw (10′) to disengage from the hook (32) of the latch-hook (28) so as to release the door (5). Conversely, when closing the door (5), the claw (10′) of the latch-head (10) is automatically engaged with the hook (32) of the latch-hook (28).

What is claimed is:

1. A door latching assembly for a microwave oven, comprising:

a housing provided with a door, said door having a latch head means for securing the door and a lever means, operatively associated with the latch head means, for releasing the latch head means;

a door opening/closing unit having a horizontal plate provided between downwardly projecting vertical supporting plates, said horizontal plate further provided with an upwardly projecting vertical base plate extending from a side of said horizontal plate, said upwardly projecting vertical base plate being positioned behind a front panel aligned with the door;

a latch hook attached to the upwardly projecting vertical base plate so that the latch hook and the latch head means releasably engage behind a peripheral edge of the door wherein the latch head means is thereby secured to the vertical base plate;

said door opening/closing unit including said latch hook, upwardly projecting vertical plate, horizontal plate and downwardly projecting vertical plates being secured only to the bottom plate of the oven.

2. A door latching assembly for a microwave oven, comprising:

a housing provided with a door, said door having a latch head means for securing the door and a lever means, operatively associated with the latch head means, for releasing the latch head means;

door opening and closing means, provided with a latch hook, secured only to a floor portion of the oven and disposed behind a front panel aligned with the door, for engaging the latch head means and the lever means; and said door opening and closing means further including a vertical base plate having a latch-hook means for releasably securing the latch-head, said door opening and closing means, vertical base plate and latch hook being secured only to the bottom plate of the oven.

3. The door latching assembly according to claim 2, wherein the vertical base plate has a wide face surface relative to the edges, said wide face surface being mounted substantially parallel to the front panel of the oven.

4. The door latching assembly according to claim 2, wherein the door opening and closing means comprises at least two leg portions secured to the floor.

* * * * *